US006089052A

United States Patent [19]

Riegger

[11] Patent Number: 6,089,052

[45] Date of Patent: Jul. 18, 2000

[54] WEFT BINDING LAYERED KNITTING

[76] Inventor: Stephen Riegger, 7834 87th St., Glendale, N.Y. 11385

[21] Appl. No.: 09/136,150

[22] Filed: Aug. 18, 1998

[51] Int. Cl.[7] ..... D04B 21/00

[52] U.S. Cl. ..... 66/195; 66/196

[58] Field of Search ..... 66/169 R, 170, 66/190, 191, 194, 198, 196, 195, 202; 442/304, 312

[56] References Cited

U.S. PATENT DOCUMENTS

| | | | |
|---|---|---|---|
| 709,734 | 9/1902 | Bellis | 66/196 |
| 709,827 | 9/1902 | Scott | 66/196 |
| 2,372,497 | 3/1945 | Johnson et al. | 66/190 |
| 3,561,234 | 2/1971 | Miskcon et al. | 66/196 |
| 4,787,219 | 11/1988 | Sato et al. | 66/190 |
| 4,922,969 | 5/1990 | Campman et al. . | |
| 5,021,283 | 6/1991 | Takenaka et al. . | |
| 5,297,296 | 3/1994 | Moretz et al. . | |
| 5,315,717 | 5/1994 | Moretz et al. . | |
| 5,385,036 | 1/1995 | Spillane et al. | 66/196 |
| 5,395,684 | 3/1995 | Robinson et al. | 442/312 |
| 5,887,453 | 3/1999 | Woods | 66/171 |

*Primary Examiner*—Danny Worrell
*Attorney, Agent, or Firm*—Michael I. Kroll

[57] ABSTRACT

A fabric including three layers. The three layers include an inner knitted layer having predetermined characteristics, an outer knitted layer having predetermined characteristics and a middle layer binding the inner layer to the outer layer. The middle layer binds the inner and outer layers such that the inner layer and outer layer remain independent of each other and retain their respective individual predetermined characteristics and without compromising the integrity of the materials forming each individual layer. The inner, outer and middle layers may be made of the same or different materials in any combination desired. A pattern may be applied to either or both the inner and outer layer by tucking the middle layer between the inner and outer layers. The middle layer is not formed by knitting.

11 Claims, 4 Drawing Sheets

WEFT BINDING LAYERED KNITTING

BACKGROUND OF THE INVENTION

1. Field of the Invention

The present invention relates generally to fabrics and, more specifically, to binding two knitted layers of similar or dissimilar materials using a third middle layer, the middle layer being entwined between the inner and outer layers and whereby the inner and outer layers retain their original characteristics.

2. Description of the Prior Art

Numerous methods of adhering multiple layers of material together and fabrics formed from adhering two dissimilar materials together have been provided in the prior art. For example, U.S. patents numbered U.S. Pat. Nos. 4,922,969; 5,021,283; 5,297,296 and 5,315,717 all are illustrative of such prior art. While these units may be suitable for the particular purpose to which they address, they would not be as suitable for the purposes of the present invention as heretofore described.

It is thus desirable to provide a composite material made from binding an inner layer and an outer layer of material together by tucking the inner and outer layers with a middle layer. The tucking acting to bind the two layers. This allows a pattern to be knit on either or both the inner and outer layers without disrupting the other layer.

In a multi-layer woven fabric in which a first yarn system forms yarn layers between the opposite broad surfaces of the fabric and a second yarn system extends through the fabric thickness between the opposite broad surfaces and is interwoven with the yarn layers, at least one of the first and second yarn systems is comprised of two or more different yarn groups of different materials such as carbon, ceramics, metals and organics to be disposed uniformly throughout the fabric thickness or to be concentrated within particular portions of the fabric thickness. In this manner multi-layer woven fabrics can be customized for particular applications in terms of their chemical, electrical, thermal, ablative, optical or other properties while retaining the advantageous structural characteristics of such fabrics. Both angle interlock and layer-to-layer weaving configurations may be used. A third or stuffer yarn system may be present and may be comprised of different material compositions at different portions of the fabric thickness where desired.

Disclosed is a woven fabric having a plurality of fabric layers which are integrated through combined portions formed by interlacing warps or wefts of one of adjacent layers of some of warps or wefts of said one layer and warps or wefts of the other layer or some of warps or wefts of said other layer with common warps or wefts, wherein a set of adjacent four layers comprises recurring structural units comprising (A) a part having one combined portion formed by intermediate two layers, (B) a first non-combined part having no combined portion, (C) a part having two combined portions formed by subsequent two layers, respectively, and (D) a second non-combined part having no combined portion. A honeycomb structure having cells of a shape of tetragons, hexagons or a combination thereof is formed among the entire layers when the multi-layer fabric is expanded. 40–100 wt. % of the fibers constituting the fabric are organic fibers which are infusable or have a melting point of at least 300° C. And have an initial modulus of at least 250 g/d, and 0–60 wt. % of the fibers constituting the fabric are inorganic fibers or metal fibers. A composite material comprising the multi-layer fabric as a re-enforcer and a thermoplastic resin as a matrix has good mechanical strengths and thermal resistance and is valuable, e.g., as a structural material for an aircraft.

A multi-layer moisture management elastic fabric including a moisture transport fabric layer constructed of hydrophobic yarns and defining a first fabric face for residing in skin contact during garment wear and for wicking moisture away from the skin. A moisture dispersal fabric layer is constructed of hydrophilic yarns and defines a second fabric face for residing in spaced apart relation from the skin during garment wear and for receiving moisture from the hydrophobic moisture transport layer. Elastic yarns are integrated with the yarns of the moisture transport fabric layer and the yarns of the moisture dispersal fabric layer to form a single, integrated fabric which is highly elastic. The fabric is useful as waistband material and as athletic headbands, wristbands and as medical bandages and braces.

A multi-layer moisture management fabric for being placed in garments. The multi-layer fabric includes a relatively thick inner moisture permeable hydrophobic fabric layer for being positioned next to the skin of the wearer of the garment, a first, relatively thin intermediate hydrophilic fabric layer positioned adjacent the hydrophobic fabric layer on the side thereof away from the skin of the wearer, and a second, relatively thick outer hydrophilic fabric layer on the opposite side thereof from the hydrophobic fabric layer.

SUMMARY OF THE PRESENT INVENTION

The present invention relates generally to fabrics and, more specifically, to binding two knitted layers of similar or dissimilar materials using a third middle layer, the middle layer being entwined between the inner and outer layers and whereby the inner and outer layers retain their original characteristics.

A primary object of the present invention is to provide a fabric formed from two separate and distinct layers bound by a middle layer that will overcome the shortcomings of prior art devices.

Another object of the present invention is to provide a fabric formed from two separate and distinct layers bound by a middle layer, said layers being combined using a weft knitting machine.

A further object of the present invention is to provide a fabric formed from two separate and distinct layers bound by a middle layer which is able to enhance the range of available composite knitted materials beyond the present range of available materials.

A yet further object of the present invention is to provide a fabric formed from two separate and distinct layers bound by a middle layer wherein the individual material layers are able to be bound with any other selected material whereby the integrity of either material is not compromised and each layer of material retains its individual characteristics.

A still further object of the present invention is to provide a fabric formed from two separate and distinct layers bound by a middle layer formed by jacquard knitting on both the inner and outer layers by means of floating loops or on one layer to produce a reversible garment.

A further object of the present invention is to provide a fabric formed from two separate and distinct layers bound by a middle layer wherein a pattern may be applied to one layer without affecting the other layer. Such is performed by tucking the binding yarn into the two layers, without actually knitting the binding yarn to the other two layers.

Another object of the present invention is to provide a fabric formed from two separate and distinct layers bound by a middle layer that is simple and easy to use.

A still further object of the present invention is to provide a fabric formed from two separate and distinct layers bound by a middle layer that is economical in cost to manufacture.

Additional objects of the present invention will appear as the description proceeds.

A fabric including three layers is disclosed by the present invention. The three layers include an inner knitted layer having predetermined characteristics, an outer knitted layer having predetermined characteristics and a middle layer binding the inner layer to the outer layer. The middle layer binds the inner and outer layers such that the inner layer and outer layer remain independent of each other and retain their respective individual predetermined characteristics and without compromising the integrity of the materials forming each individual layer. The inner, outer and middle layers may be made of the same or different materials in any combination desired. A pattern may be applied to either or both the inner and outer layer by tucking the middle layer between the inner and outer layers. The middle layer is not formed by knitting.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 3:
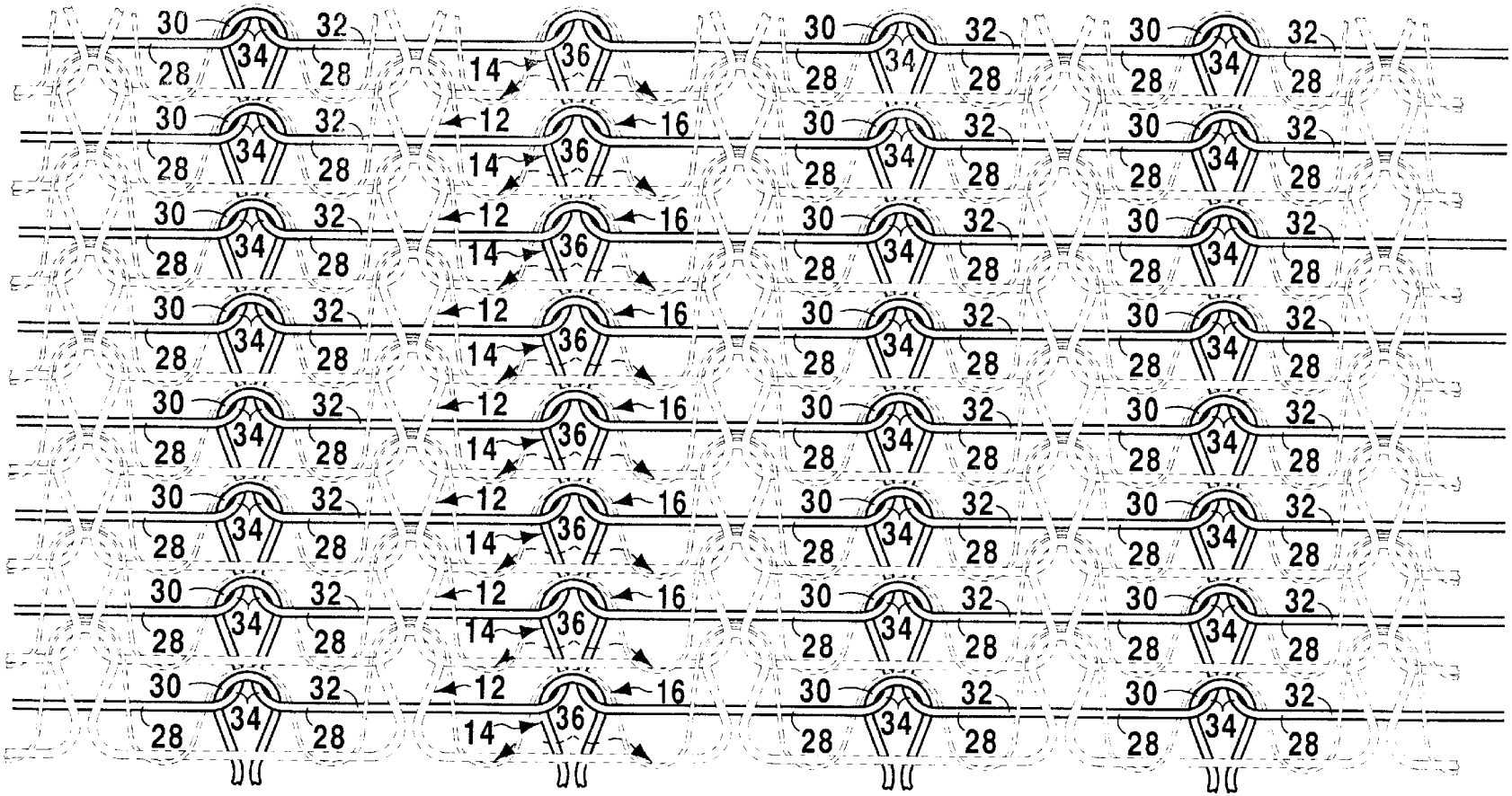
Figure 4:
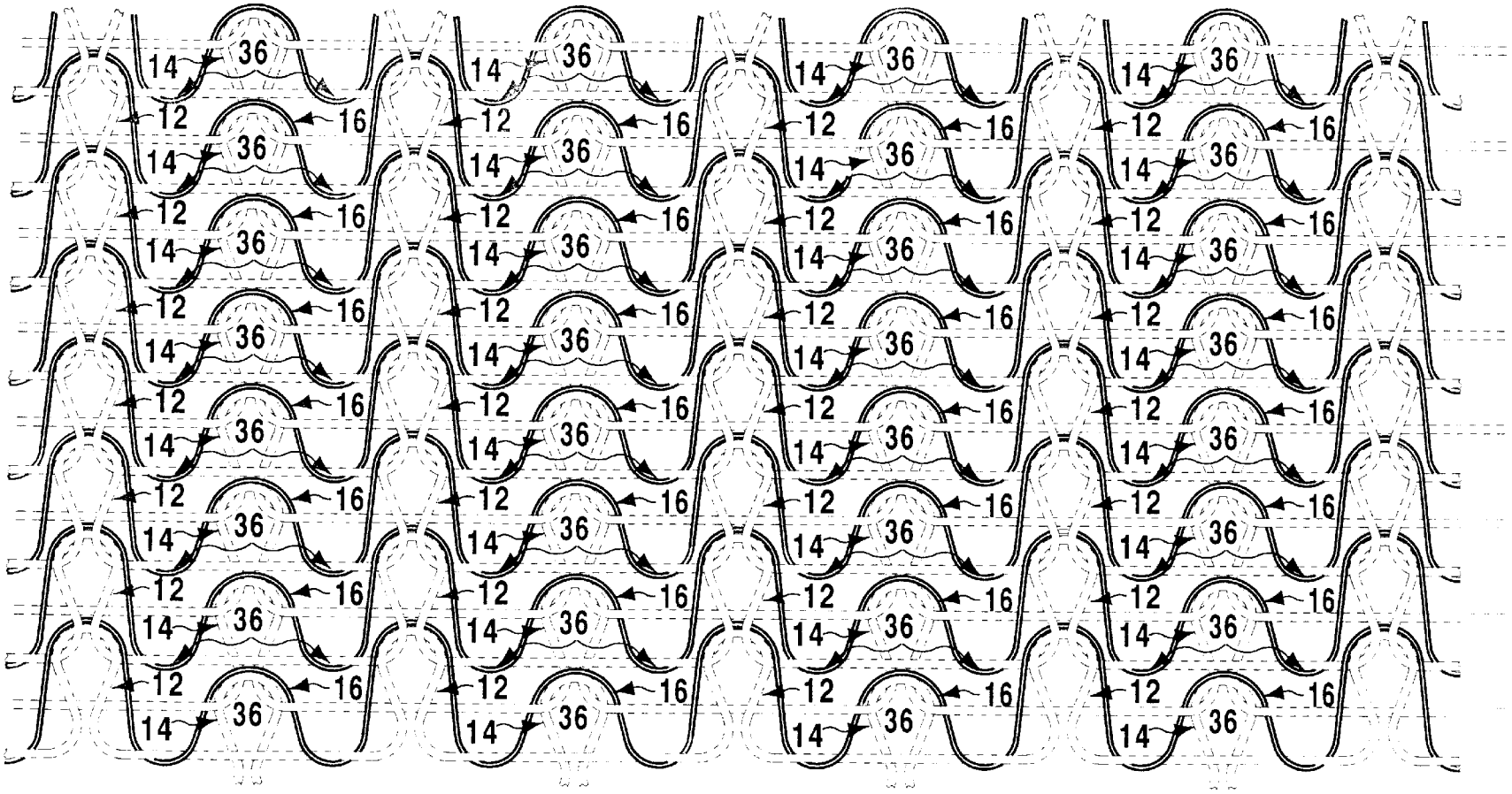

FIG. 3 is a top perspective view of the fabric formed from two separate and distinct layers bound by a middle layer of the present invention, the inner and middle layers being illustrated in dashed lines; and FIG. 4 is a top perspective view of the fabric formed from two separate and distinct layers bound by a middle layer of the present invention, the inner and outer layers being illustrated in dashed lines.

DESCRIPTION OF THE REFERENCED NUMERALS

Turning now descriptively to the drawings, in which similar reference characters denote similar elements throughout the several views, the Figures illustrate the fabric formed from two separate and distinct layers bound by a middle layer of the present invention. With regard to the reference numerals used, the following numbering is used throughout the various drawing figures.

10 fabric formed from two separate and distinct layers bound by a middle layer of the present invention
12 inner layer
14 outer layer
16 middle layer
20 line of fabric forming inner layer
22 loop of inner layer
24 mid section of inner layer
26 point at adjoining loops of adjacent lines forming inner layer
28 line of fabric forming outer layer
30 loop of outer layer
32 mid section of outer layer
34 point at adjoining loops of adjacent lines forming outer layer
36 point at which middle layer wraps around mid section of inner layer

DETAILED DESCRIPTION OF THE PREFERRED EMBODIMENT

Turning now descriptively to the drawings, in which similar reference characters denote similar elements throughout the several views, FIGS. 1 through 4 illustrate the fabric formed from two separate and distinct layers bound by a middle layer of the present invention indicated generally by the numeral 10.

Figure 1:
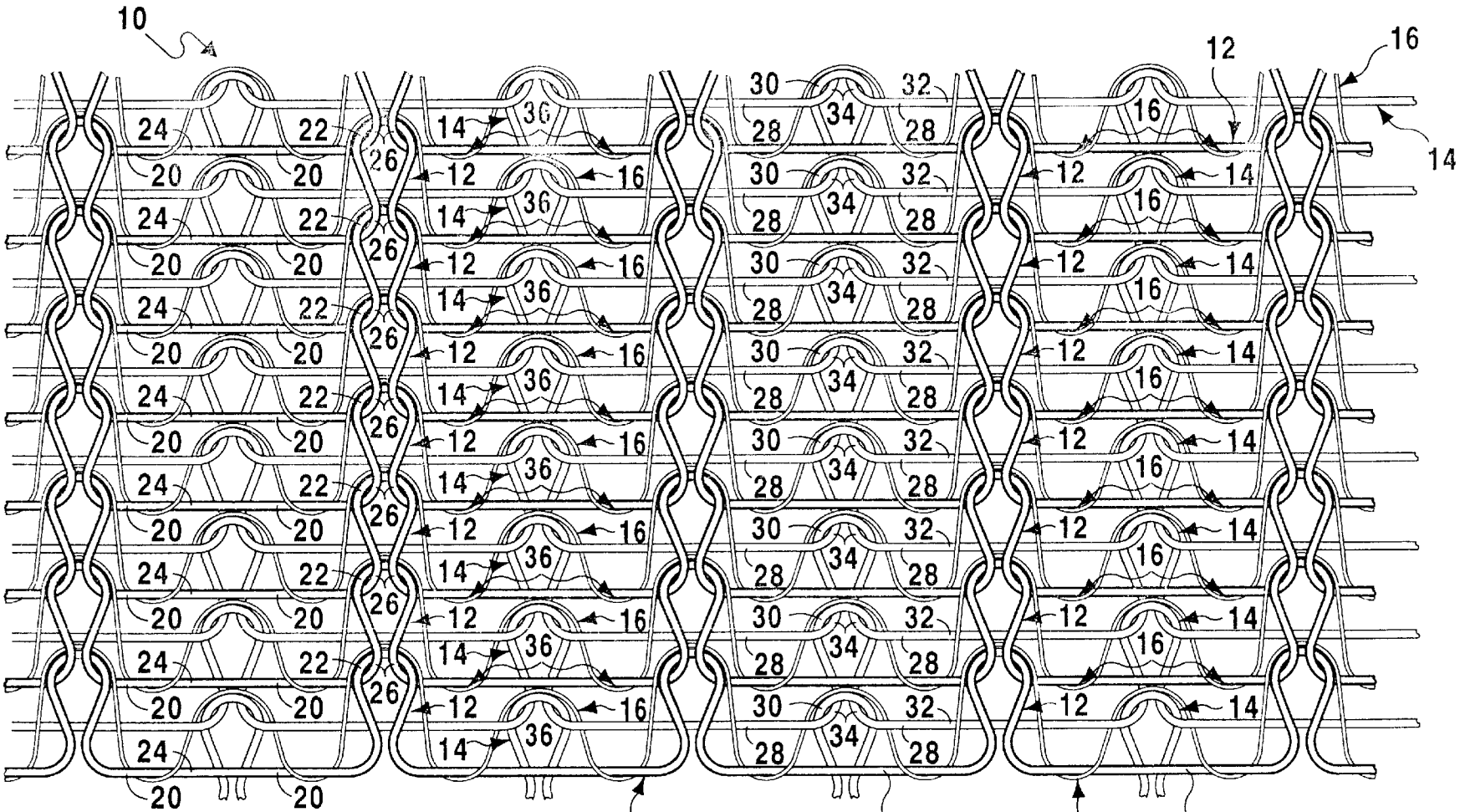
FIG. 1 is a top perspective view of the fabric formed from two separate and distinct layers bound by a middle layer of the present invention.

The fabric 10 of the present invention is illustrated in FIG. 1. The fabric 10 is formed of three individual layered fabrics, an inner layer 12, an outer layer 14 and a middle layer 16 engaging both the inner and outer layers 12 and 14, respectively, to combine the three layers. Both the inner and outer layers 12 and 14, respectively, are knitted fabrics. The inner layer 12 and the outer layer 14 are bound together by the middle layer 16 but remain independent of each other retaining their individual characteristics. Furthermore, binding of the inner and outer layers does not compromise the integrity of either material layer.

The inner layer 12 is formed of a plurality of lines of fabric 20 forming as series of loops 22 spaced apart by a mid section 24. The loops 22 of each line 20 are wound around an aligned loop 22 of an adjacent line 20 to form a loop connection at a point indicated by the numeral 26 thereby interconnecting the lines 20 and forming the inner layer of material 12.

The outer layer 14 is also formed of a plurality of lines of fabric 28 forming a series of loops 30 spaced apart by a mid section 32. The loops 30 of each line 28 are wound around an aligned loop 30 of an adjacent line 28 to form a loop connection at a point indicated by the numeral 34 thereby interconnecting the lines 28 to form the outer layer of material 14.

The middle layer 16 is wound behind one of the loop connections 26 of the inner layer 12, around the mid section 24 of the inner layer 12 and in front of one of the loop connections 34 of the outer layer 14. The middle layer 16 extends such that it is wound behind each loop connection 26 of the inner layer 12, around the mid section connected to one of the loops 22 of the loop connection 22 and in front of each loop connection 34 of the outer layer 14. When the middle layer 16 is wound in this manner, the inner, middle and outer layers 12, 14 and 16 will be connected together whereby the inner and outer layers 12 and 14 will remain independent of each other.

Figure 2:
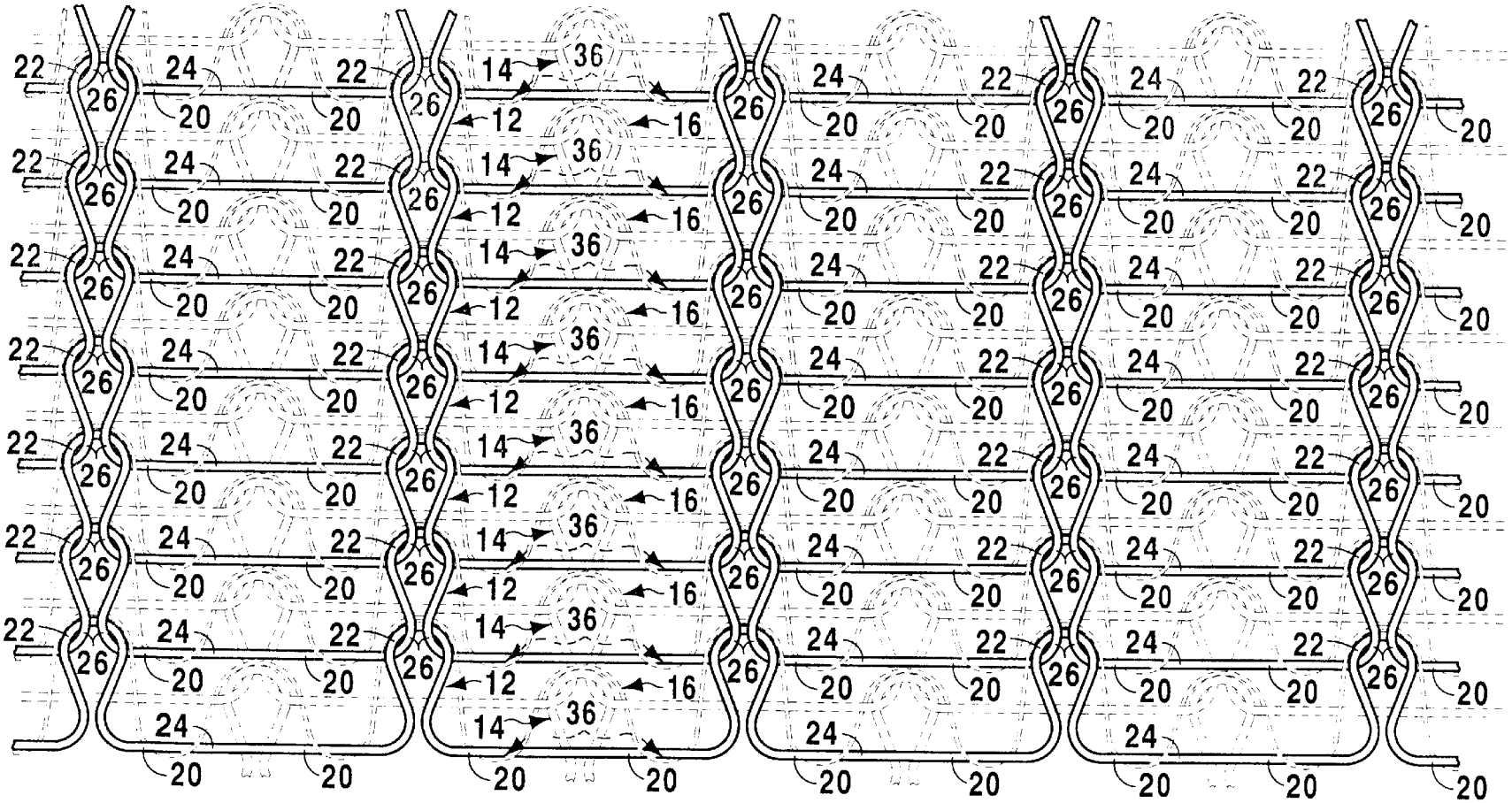
FIG. 2 is a top perspective view of the fabric formed from two separate and distinct layers bound by a middle layer of the present invention, the middle and outer layers being illustrated in dashed lines.

FIG. 2 illustrates the inner layer of material 12 with the outer and middle layers 14 and 16, respectively, shown in dashed lines. As can be seen from this figure the inner layer 12 is formed of the plurality of lines of fabric 20. Each line 20 forms the series of loops 22. Each loop 22 is spaced from adjacent loops 22 on either side thereof by mid sections 24 positioned therebetween. The loops 22 of each line 20 are wound around an aligned loop 22 of an adjacent line 20 to form the loop connection at the point 26. When the loops 22 of one line 20 are all wound around their aligned loop 22 of the adjacent line 20, the lines are connected together. When the plurality of lines 20 are all interconnected in this manner, the inner layer 12 is produced. As can also be seen from this figure, the inner layer 12 does not interact with the outer layer 14. The middle layer 16 however is threaded behind each loop connection 26 of the inner layer 12. The middle layer 16 then passes around the mid section 24 of the inner layer 12 at a point 36 and in front of the loop connection 34 of the outer layer 14.

FIG. 3 illustrates the outer layer of material 14 with the inner and middle layers 12 and 16, respectively, shown in dashed lines. As can be seen from this figure the outer layer 14 is formed of the plurality of lines 28. Each line 28 forms the series of loops 30. Each loop 30 is spaced from adjacent loops 30 by mid sections 32 positioned therebetween. The loops 30 of each line 28 are wound around an aligned loop 30 of an adjacent line 28 to form the loop connection at the point 34. When the loops 30 of one line 28 are all wound around their aligned loop 30 of the adjacent line 28, the two adjacent lines 28 are connected together. When the plurality of lines 28 are all interconnected in this manner, the outer layer 14 is produced. As can also be seen from this figure, the outer layer 14 does not interact with the inner layer 12. The middle layer 16 however loops in front of each loop connection 34 of the outer layer 14. The middle layer 16 then passes around the mid section 24 of the inner layer 12 at a point 36 and behind the loop connection 26 of the inner layer 12.

FIG. 4 shows the middle layer 16 in bold while depicting the inner and outer layers 12 and 14, respectively, in dashed lines. From this figure, it can be seen that the middle layer 16 binds the inner layer 12 and the outer layer 14 together whereby the inner and outer layers 12 and 14, respectively, remain independent of one another. The middle layer 16 is threaded behind the inner layer 12 at the point 26 wherein inter engaging loops 22 of adjacent lines 20 forming the inner layer 12 and then is wrapped down around the mid section 24 of the inner layer 12 extending from the loop 22 behind which it was threaded. The middle layer 16 is then threaded in front of the outer layer 14 at the connection point 34 of adjacent and inter engaging loops 30. This pattern of threading the middle layer 16 behind the connection point 26 around the mid section 24 and in front of the connection point 34 is continued throughout the entire piece of material thereby forming the fabric 10 made of three individual layered fabrics, an inner layer 12 and an outer layer 14 bound together by a middle layer 18.

The threads forming the middle layer 16 are preferably threaded around alternating loops of the inner and outer layers 12 and 14, respectively. Alternatively, the threads forming the middle layer 16 may be looped around any pattern of loops of the inner and outer layers 12 and 14, respectivelty, such as every third loop of the inner and outer layers 12 and 14, every fourth loop of the inner and outer layers 12 and 14, or any combination of loops of the inner and outer layers 12 and 14. The pattern of threading around the loops of the inner layer may also be different than the pattern of threading around the loops of the outer layer.

While a preferred pattern for threading the threads of the middle layer around the loops of the inner and outer layers to bind the inner and outer layers together while allowing the inner and outer layers to retain their individual characteristics is shown and described herein, those of ordinary skill in the art who have read this description will appreciate that there are numerous other patterns and devices for threading the threads of the middle layer around the loops of the inner and outer layers to bind the inner and outer layers together while allowing the inner and outer layers to retain their individual characteristics and, therefore, as used herein the phrase "means for binding the inner and outer layers" should be construed as including all such mechanisms as long as they achieve the desired result of binding the inner and outer layers while allowing the inner and outer layers to retain their individual characteristics, and, therefore, that all such alternative mechanisms are to be considered as equivalent to the one described herein.

The middle layer may also be formed using one or more threads to bind the inner and outer layers. The use of two threads is for purposes of example only and not meant to limit the application in any manner.

Furthermore, the fabric 10 of the present invention is not limited by the material used for any of the inner, outer and middle layers. The inner, outer and middle layers may be formed of any material desired such as but not limited to wool, wool/acrylic blends, cotton and any combination thereof. The only limitation on the type of material used is the purpose desired for the fabric 10. Furthermore, each layer may be formed from a different or similar material. The type of material used for each layer is a design choice of the producer based on the intended use of the material.

The fabric formed from two separate and distinct layers bound by a middle layer 10 has many uses. For example, the fabric 10 can be designed for a particular activity or job. Such as for a firefighter, a garment having a fire retardant outer layer and a performance or moisture wicking inner layer may be produced.

From the above description it can be seen that the ladder including storage areas of the present invention is able to overcome the shortcomings of prior art devices by providing a fabric formed by tucking the inner and outer layers by the middle layer. This technique enables the production of a float jacquard pattern on one or both sides of the garment produced without compromising the integrity of either side. A reversible garment can be produced with a pattern being formed on both sides of the garment whereby the inner and outer layers act completely independent of each other but are combined by the middle layer. The layers are normally combined using a weft knitting machine which is able to enhance the range of available composite knitted materials beyond the present range of available materials. The fabric formed from two separate and distinct layers bound by a middle layer allows individual materials to be bound with any other selected material without compromising the integrity of either material and retain their individual characteristics. The fabric formed from two separate and distinct layers bound by a middle layer is formed by jacquard knitting on both the inner and outer layers by means of floating loops or on one layer to produce a reversible garment whereby a pattern may be applied to one layer without affecting the other layer. Furthermore, the fabric formed from two separate and distinct layers bound by a middle layer of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fabric comprising:

a) a knitted inner layer having predetermined characteristics;

b) a knitted outer layer having predetermined characteristics; and c) means comprising an unknitted middle layer for binding the inner layer to the outer layer in such a way that the inner layer and outer layer remain independent of each other and retain their respective individual predetermined characteristics, said middle layer comprising spaced parallel rows of threads in which in alternate rows the threads are interlaced with the inner layer and in adjacent alternate rows the threads are interlaced with the outer layer.

2. The fabric as recited in claim 1, wherein said inner and outer layers are formed by weft knitting.

3. The fabric as recited in claim 2, wherein said knitted material forming said inner layer includes a plurality of spaced lines, each line having a series of alternating loops and middle sections, whereby aligned loops of each adjacent line are interconnected to form a connection point.

4. The fabric as recited in claim 1, wherein said knitted material forming said outer layer includes a plurality of spaced lines, each line having a series of alternating loops and middle sections, whereby aligned loops of each adjacent line are interconnected to form a connection point.

5. The fabric as recited in claim 1, wherein said knitted material forming both said inner and outer layers includes a plurality of lines, each line having a series of alternating loops and middle sections, whereby aligned loops of each adjacent line are interconnected to form a connection point.

6. The fabric as recited in claim 5, wherein said middle layer extends behind said loops of said inner layer and in front of said loops of said outer layer in an alternating fashion.

7. The fabric as recited in claim 6, wherein said middle layer wraps around said middle sections of said inner layer after wrapping behind each of the loops of the inner layer and prior to wrapping in front of the loops of the outer layer.

8. The fabric as recited in claim 7, wherein said middle layer is wrapped behind said loops of said inner layer at said connection points.

9. The fabric as recited in claim 7, wherein said middle layer is wrapped behind said loops of said inner layer at said connection points.

10. The fabric as recited in claim 7, wherein said middle layer is wrapped behind a predetermined pattern of loops of said inner layer to produce a pattern on the inner layer.

11. The fabric as recited in claim 1, wherein said middle layer is wrapped in front of a predetermined pattern of loops of said outer layer to produce a pattern on the outer layer.

* * * * *